United States Patent [19]

Fountain

[11] Patent Number: 4,863,217

[45] Date of Patent: Sep. 5, 1989

[54] HAIRDRESSER'S STATION

[76] Inventor: Martin L. Fountain, 305 College St., Columbus, Miss. 39701

[21] Appl. No.: 205,279

[22] Filed: Jun. 10, 1988

[51] Int. Cl.[4] ..... A47C 15/00

[52] U.S. Cl. ..... 297/241; 108/13; 297/129

[58] Field of Search ..... 297/241, 240, 257, 124, 297/129, 130, 134; 108/25, 26, 13, 14

[56] References Cited

U.S. PATENT DOCUMENTS

| | | | |
|---|---|---|---|
| Re. 24,290 | 3/1957 | MacKnight | 297/241 |
| 689,964 | 12/1901 | Hieber . | |
| 937,625 | 10/1909 | Mead . | |
| 1,352,409 | 9/1920 | Hoefner . | |
| 1,566,151 | 12/1925 | Moore . | |
| 1,686,464 | 10/1928 | Perry . | |
| 2,212,777 | 8/1940 | Jones et al. . | |
| 2,252,137 | 8/1941 | Rummerfield . | |
| 2,264,795 | 12/1941 | Harrison et al. . | |
| 2,445,240 | 7/1948 | Paden . | |
| 2,446,376 | 8/1948 | Littlejohn . | |
| 2,449,385 | 9/1948 | Johnson et al. | 297/241 X |
| 2,477,139 | 7/1949 | Patton . | |
| 2,517,936 | 8/1950 | Spikes | 297/241 |
| 2,521,031 | 9/1950 | Alspaugh . | |
| 2,554,852 | 5/1951 | Bryan et al. | 297/241 |
| 2,557,232 | 6/1951 | Morgan . | |
| 2,836,224 | 5/1958 | Hicks | 297/241 |
| 2,837,388 | 6/1958 | Majeroni et al. | 108/25 |
| 2,848,037 | 8/1958 | MacKnight . | |
| 2,969,108 | 1/1961 | MacKnight . | |
| 3,223,449 | 12/1963 | Naylor . | |
| 4,335,924 | 6/1982 | McCloskey . | |
| 4,542,936 | 9/1985 | Gafken . | |
| 4,603,824 | 8/1986 | McCardle . | |
| 4,632,410 | 12/1986 | Bainbridge et al. | 297/124 X |

*Primary Examiner*—Peter A. Aschenbrenner
*Assistant Examiner*—Thomas A. Rendos
*Attorney, Agent, or Firm*—Finnegan, Henderson, Farabow, Garrett & Dunner

[57] ABSTRACT

A hairdresser's station capable of being mounted on a floor is disclosed. The station includes a customer's chair assembly that includes a customer's seat, a first base, and a first shaft for adjustably fixing the customer's seat to the first base. A traveling assembly is also provided for moving radially relative to the customer's chair assembly within a fixed range and circumferentially around the customer's chair assembly. The traveling assembly includes a second base, rolling means affixed to the second base for allowing the traveling assembly to travel freely over the floor, and a second shaft fixed at one end to the second base. Rotation means are provided in rotatable engagement with the first shaft for providing a point of attachment that is free to rotate about the first shaft. A slide shaft is fixed to the attachment point of the rotation means and extends in a direction substantially perpendicular to the first shaft. Slide means are provided that are in slidable engagement with the slide shaft and include a point of attachment that is free to slide along the slide shaft. Fixing means fix the point of attachment of the slide means to the second base of the traveling hairdresser's assembly.

19 Claims, 4 Drawing Sheets

HAIRDRESSER'S STATION

FIELD OF THE INVENTION

The present invention relates to a hairdresser's station and, more particularly, to a hairdressers' station that includes a traveling assembly that is radially and circumferentially movable relative to a customer's chair.

BACKGROUND OF THE INVENTION

Hairdressing or haircutting can be a tiring occupation. A hairdresser must often spend up to ten hours per day on his or her feet performing a variety of operations on a customer's hair such as, for example, cutting. The fatigue occasioned by such a schedule is physically debilitating and mentally fatiguing to such an extent that the quality of the service performed may suffer. Further, for some individuals with physical impairments standing is difficult, if not impossible.

A hairdresser must also have ready variety of hairdressing implements, such as scissors, razors, curlers, and the like and expendable items, such as hairspray, gels, water, and the like. A fixed table provides a surface to hold such implements or items but must be reached by walking from a position contiguous with the customer's chair to the table and back again. This only increases the amount of walking a hairdresser must do and, concomintantly increases the fatigue suffered by the hairdresser.

It in desirous, therefore, to provide a device whereby a hairdresser may sit while cutting a customer's hair but still have a complete and easily attainable range of action around the customer. An example of a prior art apparatus is U.S. Pat. No. 1,352,409 to Hoefner wherein a barber's chair is disclosed as having a traveling stool attached thereto. The arrangement in accordance with the '409 patent is, however, quite complex to manufacture and use. Further, it does not provide for ease of use by the hairdresser to sit upon or alight from the traveling stool, or swivel or elevate the traveling stool.

It is also desirous to provide a tray that is capable of holding hairdressing implements and is readily moved relative to a customer's chair to provide close and easy access to the implements while the hairdresser is cutting the customer's hair.

BRIEF DESCRIPTION OF THE INVENTION

The present invention overcomes the problems and disadvantages of the prior art by providing a hairdresser's station that includes a customer's chair and a traveling assembly that can easily and controllably be rotated circumferentially about the customer's chair, moved radially relative to the hairdresser's chair and elevated relative to the customer's chair. Further, a hairdresser's station in accordance with the present invention is not complex to fabricate or use and is readily adapted to provide either a seat for a hairdresser or a tray to hold hairdressing implements or expendable items.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a hairdresser's station of this invention capable of being mounted on a floor comprises a customer's chair assembly including a customer's seat, a first base, and a first shaft for adjustably fixing the customer's seat to the first base; a traveling assembly for moving radially relative to the customer's chair assembly within a fixed range and circumferentially around the customer's chair assembly, the traveling assembly including a second base, rolling means affixed to the second base for allowing the traveling assembly to travel freely over the floor, and a second shaft fixed at one end to the second base; rotation means in rotatable engagement with the first shaft for providing a point of attachment that is free to rotate about said first shaft; a slide shaft fixed to the point of attachment of the rotation means and extending in a direction substantially perpendicular to the first shaft; slide means in slidable engagement with the slide shaft for providing a point of attachment that is free to slide along said slide shaft; and fixing means for fixing the point of attachment of the slide shaft to the base of the traveling stool.

The hairdresser's station according to this invention is easier and less expensive to manufacture because of its structure which is considerably simpler than that of prior hairdresser chairs.

Broadly, hairdresser's station may include a hairdresser's seat disposed on the second shaft, the slide shaft being disposed vertically higher than the point at which the fixing means is attached to the second base. The fixing means thus form oblique angles with both the slide shaft and the second shaft. This allows much easier access to the hairdresser's seat and also permits movement by the hairdresser for easy access to the customer and to facilitate manipulation of the traveling assembly without an encumbering structure being in the way of the hairdresser.

Alternatively, the hairdresser's station may include a tray disposed on the second shaft to hold hairdressing implements or expendable items. The fixing means also form an oblique angle with the slide shaft and the second shaft to provide ease of movement and operation by the hairdresser around the tray.

The accompanying drawings, which are incorporated in and constitute a part of this specification, illustrate one embodiment of the invention and, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

Figure 1:
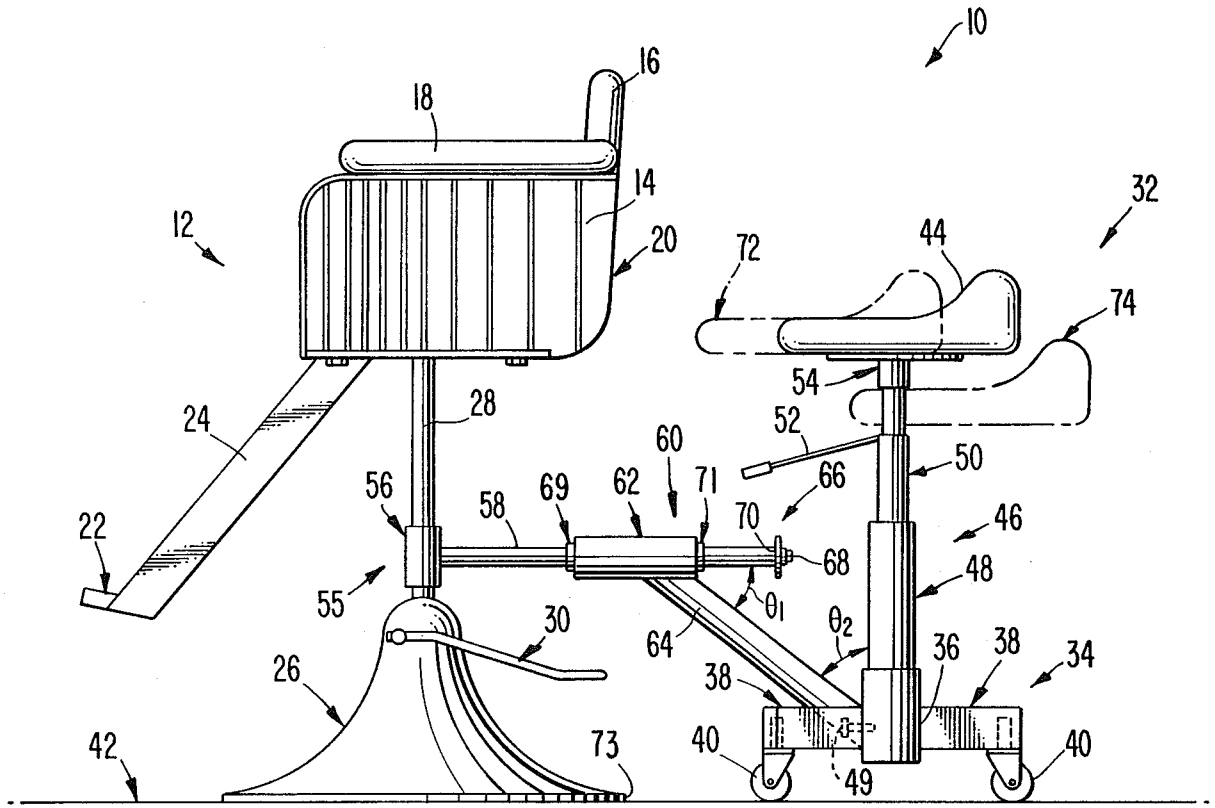
FIG. 1 is a side elevational view of a hairdresser's station in accordance with the present invention, including a hairdresser'seat.
Figure 2:
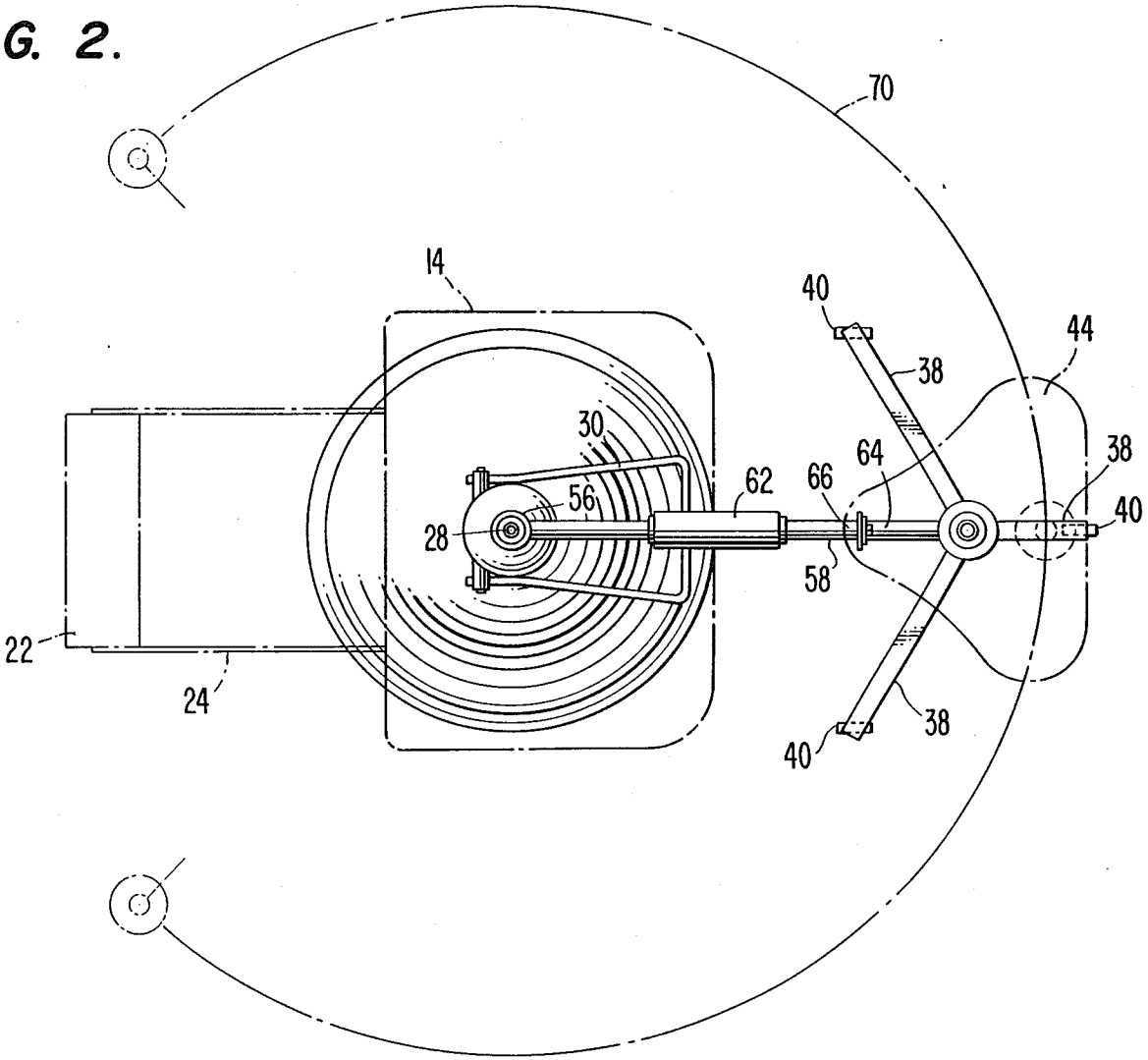
FIG. 2 is a top view of a hairdresser's station in accordance with the present invention, including a hairdresser's seat.
Figure 3:
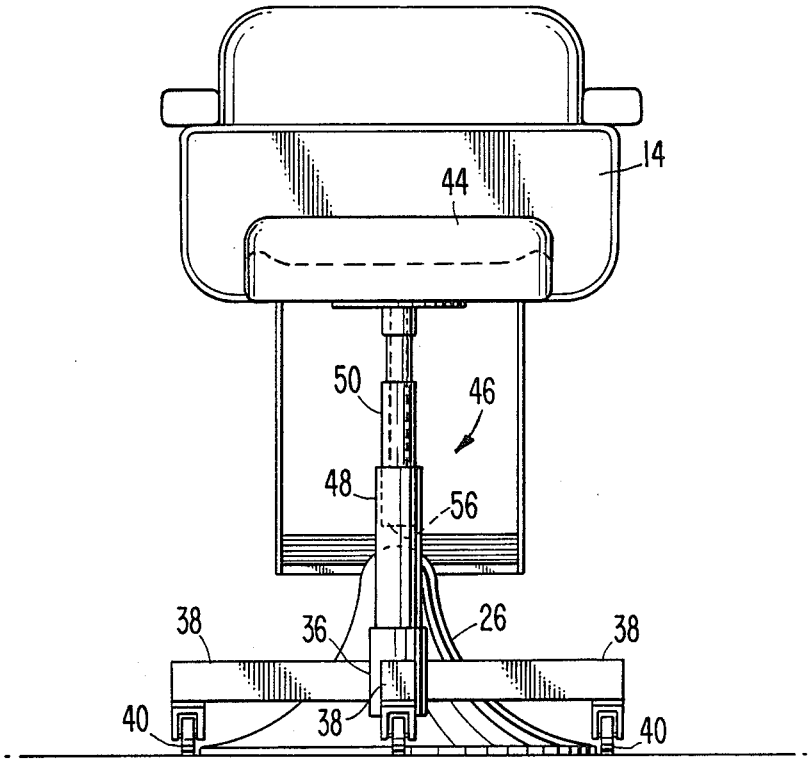
FIG. 3 is a front elevational view of a hairdresser's station in accordance with the present invention, including a hairdresser's seat.

The preferred embodiment of a hairdresser's station capable of being mounted on a floor in accordance with the present invention is shown in FIGS. 1–3 and designated generally by the numeral 10.

In accordance with the present invention the hairdresser's station includes a customer's chair assembly, designated generally by the numeral 12. The customer's chair assembly 12, in accordance with the present invention, includes a customer's seat, a first base, and a first shaft for adjustably fixing the customer's seat to the first base. As embodied herein, a customer's seat 14 is provided that includes a seat back 16 and arm rests 18 disposed on a seat frame 20. A foot rest 22 is provided attached to seat frame 20 by a foot rest support 24. Customer's seat 14 may be, for example, Belmont model no. 598-FB-05-67, manufactured by Takara Belmont of Somerset, N.J.

As embodied herein, a first base 26 is provided for supporting customer's seat 14 through a first shaft 28. First base 26 preferably includes first elevator means within it for controllably elevating the first shaft relative to the first base to controllably elevate the customer's seat relative to the first base. The elevator means, not shown, can be, for example, an hydraulic pump operably connected to first shaft 28 within first base 26. The elevator means are operated by, for example, a foot operated lever 30. Alternatively, the elevator means may be a screw-type jack or an electronically controlled gear assembly.

As embodied herein, first shaft 28 is a rigid circular member, for example, a steel pipe. First shaft 28 may be of any material and configuration, however, that satisfies the purposes of the present invention.

In accordance with the present invention, the hairdresser's station includes a traveling assembly for moving radially relative to the customer's chair assembly within a fixed range and circumferentially around the customers chair assembly. As embodied herein, a traveling assembly, designated generally by the numeral 32, is provided. In accordance with the present invention, the traveling assembly includes a second base, rolling means affixed to the second base for allowing the traveling stool to travel freely over the floor, and a second shaft fixed at one end to the second base.

As embodied herein, the traveling assembly includes a second base 34. Second base 34 includes a hub 36 and a plurality of legs 38 extending therefrom. Legs 38 may be affixed to hub 36 by, for example, welding. The rolling means affixed to the second base for allowing the traveling assembly to travel freely over the floor preferably includes three or more casters fixed to the second base and in rolling engagement with the floor. As embodied herein a caster 40 is affixed to each of legs 38 such that casters 40 are in rolling engagement with floor 42.

Also as embodied herein, traveling assembly 32 includes a second shaft 46. As embodied herein, second shaft 46 includes a first portion 48 and a second portion 50. First portion 48 includes second elevator means for controllably elevating second portion 50 relative to second base 34. Second elevator means can be, for example, a spring-loaded shaft, not shown, disposed in first portion 48. A spring-loaded shaft useful in the present invention may be, for example, a Curry 1U6024 Pointed Power Pedestal, Mfg. No. CMT-21, manufactured by Curry Machine Co. of Monticello, Ark. Second elevator means are controllable by a lever 52 that is linked mechanically or electronically with second elevator means disposed within first portion 48. Alternatively, the second elevator means may be embodied as a hydraulic lifting device.

Hub 36 may include a vertically adjustable joint to accommodate different models of customer's chairs. For example, a bolt 49 may be provided that is freely insertable through a hole in fixing means 64. Fixing means 64 is moveable longitudinally along hub 36. Hub 36 includes one or more internally threaded holes longitudinally spaced, match-mated to bolt 49. Thus, fixing means 64 may be moved longitudinally along hub 36 and locked in a desired position by inserting bolt 49 through the hole in fixing means 64 and engaging bolt 49 with a desired one of the internally threaded holes in hub 36.

Preferably, traveling assembly 32 includes a hairdresser's seat 44 removably fixed to the second shaft 46 distal the second base 34. In this form of the invention the second elevator means is useful to controllably elevate hairdresser's seat 44 relative to second base 34. As embodied herein, hairdresser's seat 44 is of a generally triangular shape and may be, for example, a Wise Pro Pedestal Seat, Mfg. No. WD-112, manufactured by The Wise Co. of Henderson, Tex. It should be understood, however, that hairdresser's seat 44 may be of any shape or configuration to carry out the purposes of the present invention.

Preferably, hairdresser's seat 44 is connected to second portion 50 of second shaft 46 through swivel means 54. Swivel means 54 may be, for example, a roller bearing and is provided so that hairdresser's seat 44 may be rotated freely relative to second portion 50 of second shaft 46.

Figure 4:
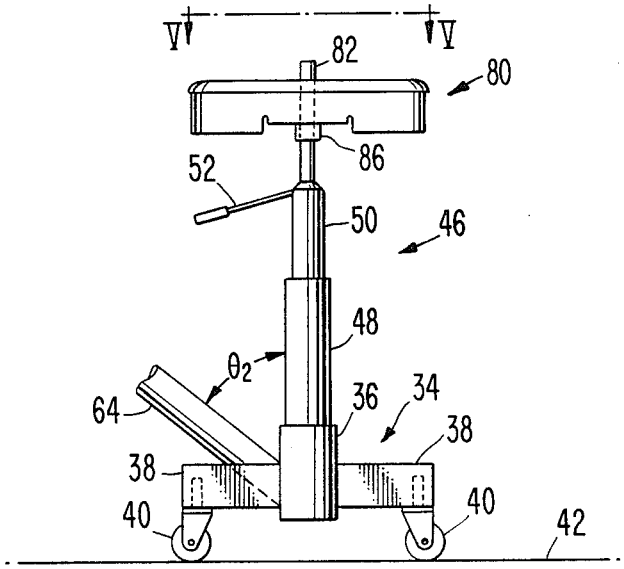
FIG. 4 is a front elevational view of a traveling assembly in accordance with the present invention including a tray.
Figure 5:
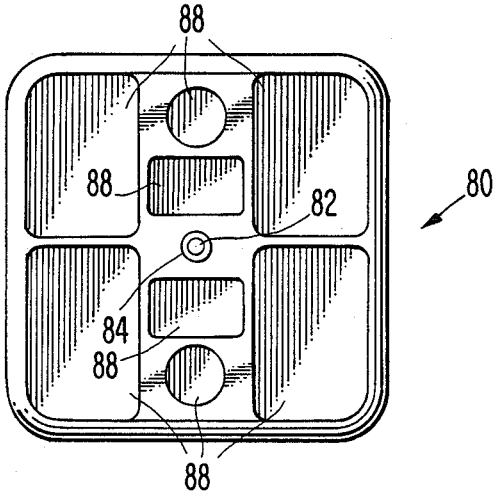
FIG. 5 is a top plan view of the tray of FIG. 4.

Alternatively, traveling assembly 32 may include a tray removably fixed to the second shaft distal the second base. As shown in FIGS. 4 and 5, tray 80 is removably fixed to second shaft 46 at an end distal second base 34. Second portion 50 of second shaft 46 includes a narrowed-down neck portion 82. Neck portion 82 passes through a hole 84 in tray 80. Preferably, adjustable collar means are provided for adjusting and fixing the axial position of the tray along the second shaft. As embodied herein, adjustable collar means 86 include an annular collar that is removably attached to neck portion 82 by, for example, a removable pin that passes through collar means 86 and engages neck portion 82 at a hole therein to axially retain collar means 86.

Preferably, tray 80 includes a plurality of recessed portions 88 of a desired variety of sizes and shapes. Recessed portions 88 are provided to hold hairdressing implements and expendable items. The choice of the number, shape, width, length or depth of recessed portions 88 is one of design choice and depends on the specific application of tray 80.

Figure 6:
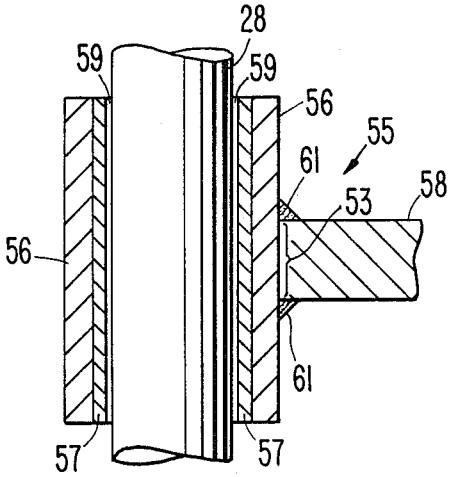
FIG. 6 is a cross-sectional view of rotation means useful in a hairdresser's station in accordance with the present invention.

In accordance with the present invention the hairdresser's station includes rotation means in rotatable engagement with the first shaft for providing a point of attachment that is free to rotate about said first shaft. As embodied herein and shown in FIG. 6, rotation means 55 preferably includes a first sleeve 56 and a first lubricatable bushing 57. First sleeve 56 provides a point of attachment 53 to which a slide shaft 58 may be attached, as is more fully explained below. First lubricatable bushing 57 is disposed between first sleeve 56 and first shaft 28. As embodied herein, first shaft 28 is of a generally circular cross-section and first lubricatable bushing 57 and first sleeve 56 are both of a generally annular cross-sectional configuration. Sufficient clearance, as designated by the numeral 59, is provided between the bushing and shaft 28 so that the bushing can freely rotate about shaft 28. In one form, first lubricatable bushing 57 has grooves, not shown, on its surface adjacent shaft 28 to allow lubrication of the mechanism.

A hairdresser's station in accordance with the present invention includes a slide shaft fixed to the point of attachment of the rotation means and extending in a direction substantially perpendicular to the first shaft. As embodied herein a slide shaft 58 is provided that is attached to the first sleeve 56 of the rotation means. The slide shaft 58 can be attached to sleeve 56 by, for example, welding as illustrated by weldment 61 of FIG. 6. Alternatively the end of slide shaft 58 attached to sleeve 56 may be externally threaded and match-mated to an internally threaded hole in sleeve 56.

Figure 7:
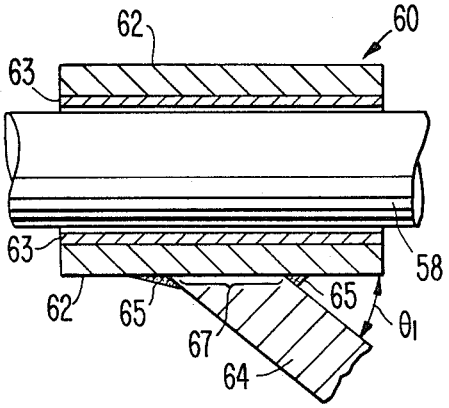
FIG. 7 is a cross-sectional view of slide means useful in a hairdresser's station in accordance with the present invention.

A hairdresser's station in accordance with the present invention includes slide means in slidable engagement with the slide shaft for providing a point of attachment that is free to slide along the slide shaft. As embodied herein, slide means 60 are provided that slidably engage slide shaft 58. Slide means 60 preferably includes a second sleeve 62 and a second lubricatable bushing 63, as shown in FIG. 7. Second lubricatable bushing 63 is disposed between second sleeve 62 and slide shaft 58. In one form, second lubricatable bushing 63 has grooves, not shown, on the inner surface adjacent slide shaft 58 to allow lubrication of the interface between second lubricatable bushing 63 and slide shaft 58.

A hairdresser's chair in accordance with the present invention includes fixing means for fixing the point of attachment of the slide means to the second base of the traveling assembly. As embodied herein, fixing means 64 are provided to fix second base 34, of traveling assembly 32 to slide means 60 at a point of attachment 67 to sleeve 62. Fixing means 64 is, preferably, a rigid tube that is, for example, welded to second sleeve 62 and second base 34 as illustrated by weldment 65 in FIG. 5.

Preferably, slide shaft 58 is disposed vertically higher than the point at which fixing means 64 is attached to second base 34. In this form, fixing means 64 forms oblique angles with both slide shaft 58 and second shaft 46. Specifically, fixing means 64 forms an angle $\theta_1$, with slide shaft 58 and forms an angle $\theta_2$ with second shaft 46. $\theta_1$ may or may not be set equal to $\theta_2$ as a matter of design choice. By providing the described arrangement of fixing means 64, a hairdresser can easily and comfortably sit upon and alight from hairdresser's seat 44 when hairdresser's seat 44 is disposed on second shaft 46. When tray 80 is disposed on second shaft 46, as shown in FIG. 4, a hairdresser can comfortably and easily have access to tray 80 and customer's chair 14. The space between second shaft 46 and fixing means 64 provides clearance for a hairdresser's legs while the hairdresser is entering the hairdresser's station 10 to sit upon hairdresser's seat 44 or alight therefrom. This clearance also makes it easier for traveling assembly 32 to be operated in a manner more fully explained below to move traveling assembly 32 radially and circumferentially relative to customer's chair assembly 12.

Preferably, stop means 66 are affixed to the end of slide shaft 58 distal the end fixed to rotation means 56. Stop means 66 are for stopping the radial movement of slide means 60 radially outward from customer's chair assembly 12. Stop means 66 may include, for example, a bolt 68 that engages a tapped hole, not shown, extending longitudinally into slide shaft 58. Bolt 68 retains a washer 70 on the end of slide shaft 58. Washer 70 is sufficiently large to prevent second sleeve 62 from passing it.

The operation of a hairdresser's station in accordance with the present invention can now be explained.

In the embodiment of the present invention wherein traveling assembly 32 includes hairdresser's seat 44, a customer may be seated in customer's seat 14 and a hairdresser may be seated on hairdresser's seat 44 in preparation for cutting the customer's hair. The hairdresser may move the traveling assembly 32 radially inwardly or outwardly by pushing with his or her feet against floor 42 to cause traveling assembly 32 to move closer to or further from, respectively, customer's chair assembly 12. This radial movement is guided by slide means 60 that is in slidable engagement with slide shaft 58, slide means 60 being fixed, via fixing means 64, to second base 34 of traveling assembly 32. The radial movement 32 relative to customer's chair assembly occurs within certain limits. The radial inward limit is set by first end 69 of slide means 60 abutting rotation means 56. Alternatively, the radial inward limit may be set by caster 40, affixed to leg 38, abutting base lip 73 of first base 26. The outer radial limit is set by second end 71 of slide means 60 abutting stop means 66.

The hairdresser may cause traveling assembly 32 to move circumferentially around customer's chair assembly by pushing with his or her feet against floor 42 to cause traveling assembly 32 to traverse an arc 70 as shown in broken line in FIG. 2. Alternatively, or in addition, the traveling assembly 32 may be manipulated by hand, the hairdresser using his or her hands to pull or push the traveling assembly 32 relative to the customer's chair assembly 12. The ability to so manipulate traveling assembly 32 by hand is especially important where the hairdresser does not have use of his or her legs.

It should be understood that while only one arc is illustrated in FIG. 2 an infinite number can be attained by selecting any one of an infinite number of radial positions prior to or during the initiation of circumferential movement of traveling assembly 32.

The relative vertical positions of and hairdresser's seat 44 or customer's seat 14 may be changed by alternately, or in combination, changing the position of the first elevator means or second elevator means, respectively, to raise or lower the hairdresser's seat 44 or customer's seat 14, respectively. Thus, as shown in FIG. 1, hairdresser's seat 44 may be moved radially inward as illustrated by phantom outline 72 or may be moved radially outward and down as illustrated by phantom outline 74.

The operation of the embodiment of the present invention wherein tray 80 is disposed on second shaft 46 is as explained above in reference to the embodiment of the present invention wherein hairdresser's seat 44 is disposed on second shaft 46 with the exception that the hairdresser is not provided with a place to sit. Hairdressing implements or expendable items are placed in recessed portions 88 of tray 80. Traveling assembly 46 can then be manipulated by the hairdresser by, for example, pushing it with his or her feet or arms to propel it radially or circumferentially relative to customer's chair assembly 12. In this way, the hairdressing implements or expendable items can be placed on tray 80 and tray 80 can then be located in a convenient location relative to the hairdresser as the hairdresser moves relative to customer's chair assembly 12.

Thus it can be seen that a hairdresser's station in accordance with the present invention can be easily and comfortably used to change the relative position of a customer and a seated hairdresser or a tray holding hairdressing implements or expendable items. The hairdresser can choose any desired combination of relative elevations, radial positions and circumferential positions for hairdresser's seat 44 or tray 80.

It will be apparent to those skilled in the art that various modifications and variations can be made in the hairdresser's station of the present invention without departing from the scope or spirit of the invention. For example, a customers chair 14, hairdresser's seat 44 or tray 80 may be provided having different shapes or configurations than those shown in the drawings. Thus, it is intended that the present invention cover the modifications and variations of this invention provided they come within the scope of the appended claims and their equivalents.

What is claimed:

1. A hairdresser's station capable of being mounted on a floor, comprising:

a customer's chair assembly including a customer's seat, a first base, and a first shaft for adjustably fixing said customer's seat to said first base;

a traveling assembly for moving radially relative to said customer's chair assembly within a fixed range and circumferentially around said customer's chair assembly, said traveling assembly including a second base, rolling means affixed to said second base for allowing said traveling assembly to travel freely over the floor, and a second shaft fixed at one end to said second base;

a hairdresser's seat removably attached to said second shaft distal said second base;

rotation means in rotatable engagement with said first shaft for providing a point of attachment that is free to rotate about said first shaft;

a slide shaft fixed to said point of attachment of said rotation means and extending in a direction substantially perpendicular to said first shaft;

slide means in slidable engagement with said slide shaft for providing a point of attachment that is free to slide along said slide shaft; and fixing means for fixing said point of attachment of said slide means to said second base of said traveling stool, said slide shaft being disposed vertically higher than the point at which the fixing means is attached to the second base, the fixing means thus forming oblique angles with both the slide shaft and the second shaft.

2. A hairdresser's station as claimed in claim 1 wherein said fixing means is a rigid tube.

3. A hairdresser's station as claimed in claim 2 wherein said rigid tube is straight.

4. A hairdresser's station as claimed in claim 1, further including second elevator means within said second shaft, said second shaft including a first portion fixed relative to said second base and a second portion being longitudinally moveable relative to said second base, said first portion including said second elevator means for controllably elevating said second portion of said second shaft relative to said second base to controllably elevate said hairdresser's seat relative to said second base.

5. A hairdresser's station as claimed in claim 1, wherein said means affixed to said second base to allow said traveling assembly to travel freely over the floor includes three or more casters fixed to said second base and in rolling engagement with the floor.

6. A hairdresser's station as claimed in claim 1 wherein said rotation means includes a first sleeve and a first lubricatable bushing, said first lubricatable bushing being disposed between said first sleeve and said first shaft and said slide shaft being fixed to said sleeve.

7. A hairdresser's station as claimed in claim 1 wherein said slide means includes a second sleeve and a second lubricatable bushing, said second lubricatable bushing being disposed between said second sleeve and said slide shaft and said fixing member being fixed to said sleeve.

8. A hairdresser's station as claimed in claim 1, further including first elevator means within said first base for controllably elevating said first shaft relative to said first base to controllably elevate said customer's seat relative to said first base.

9. A hairdresser's station as claimed in claim 1, further including stop means affixed to the end of said slide shaft distal the end fixed to said rotation means for stopping the radial movement of said slide means radially outward from said customer's chair assembly.

10. A hairdresser's station capable of being mounted on a floor, comprising:

a customer's chair assembly including a customer's seat, a first base, and a first shaft for adjustably fixing said customer's seat to said first base;

a traveling assembly for moving radially relative to said customer's chair assembly within a fixed range and circumferentially around said customer's chair assembly, said traveling assembly including a second base, rolling means affixed to said second base for allowing said traveling assembly to travel freely over the floor, and a second shaft fixed at one end to said second base;

a tray removably fixed to said second shaft distal said second base;

rotation means in rotatable agreement with said first shaft for providing a point of attachment that is free to rotate about said first shaft;

a slide shaft fixed to said point of attachment of said rotation means and extending in a direction substantially perpendicular to said first shaft;

slide means in slidable engagement with said slide shaft for providing a point of attachment that is free to slide along said slide shaft; and fixing means for fixing said point of attachment of said slide means to said second base of said traveling stool, said slide shaft being disposed vertically higher than the point at which the fixing means is attached to the second base, the fixing means thus forming oblique angles with both the slide shaft and the second shaft.

11. A hairdresser's station as claimed in claim 10 wherein said fixing means is a rigid tube.

12. A hairdresser's station as claimed in claim 11 wherein said rigid tube is straight.

13. A hairdresser's station as claimed in claim 10 further including adjustable collar means for adjusting and fixing the axial position of said tray along said second shaft.

14. A hairdresser's station as claimed in claim 10, wherein said means affixed to said second base to allow said traveling assembly to travel freely over the floor includes three or more casters fixed to said second base and in rolling engagement with the floor.

15. A hairdresser's station as claimed in claim 10, wherein said rotation means include a first sleeve and a first lubricatable bushing, said first lubricatable bushing being disposed between said first sleeve and said first shaft and said slide shaft being fixed to said sleeve.

16. A hairdresser's station as claimed in claim 10 wherein said slide means includes a second sleeve and a second lubricatable bushing, said second lubricatable bushing being disposed between said second sleeve and said slide shaft and said fixing member being fixed to said sleeve.

17. A hairdresser's station as claimed in claim 10, further including first elevator means within said first base for controllably elevating said first shaft relative to said first base to controllably elevate said customer's seat relative to said first base.

18. A hairdresser's station as claimed in claim 10, further including stop means affixed to the end of said slide shaft distal the end fixed to said rotation means for stopping the radial movement of said slide means radially outward from said customer's chair assembly.

19. A hairdresser's station capable of being mounted on a floor, comprising:

a customer's chair assembly including a customer's seat, a first base, and a first shaft for adjustably fixing said customer's seat to said first base;

a traveling assembly for moving radially relative to said customer's chair assembly within a fixed range and circumferentially around said customer's chair assembly, said traveling assembly including a second base, rolling means affixed to said second base for allowing said traveling assembly to travel freely over the floor, and a second shaft fixed at one end to said second base;

rotation means in rotatable engagement with said first shaft for providing a point of attachment that is free to rotate about said first shaft;

a slide shaft fixed to said point of attachment of said rotation means and extending in a direction substantially perpendicular to said first shaft;

slide means in a slidable engagement with said slide shaft for providing a point of attachment that is free to slide along said slide shaft, said slide means including a second sleeve and a second lubricatable bushing, said second lubricatable bushing being disposed between said second sleeve and said slide shaft and said fixing member being fixed to said sleeve; and fixing means for fixing said point of attachment of said slide means to said second base of said traveling stool.

* * * * *